United States Patent [19]

Hwang

[11] Patent Number: 4,557,122

[45] Date of Patent: Dec. 10, 1985

[54] COMBINED COMBINATION AND KEY-TYPE LOCK

[76] Inventor: Blake Hwang, No. 40, Shau An St., Taipei, Taiwan

[21] Appl. No.: 526,286

[22] Filed: Aug. 25, 1983

[51] Int. Cl.[4] ..... E05B 37/02

[52] U.S. Cl. ..... 70/312; 70/284; 70/316

[58] Field of Search ..... 70/285, 284, 312, 315–318, 70/287, 288

[56] References Cited

U.S. PATENT DOCUMENTS 4,462,232 7/1984 Yang ..... 70/312

FOREIGN PATENT DOCUMENTS 2068449 8/1981 United Kingdom ..... 70/285

*Primary Examiner*—Robert L. Wolfe

[57] ABSTRACT

A combined combination and key-type lock has both a combination lock and a key-type lock, either or both of which may be used. The combined combination and key-type lock is designed so that it can still be opened without dismantling the compound lock and the correct numbers of the combination lock can be detected even if the correct numbers of the combination lock is forgotten.

1 Claim, 26 Drawing Figures

COMBINED COMBINATION AND KEY-TYPE LOCK

BACKGROUND OF THE INVENTION

Modern locks fall into three major classifications according to application: A rim lock is applied to the surface of a door or drawer. A mortise lock is inserted in a precut cavity which has been prepared for it. A portable lock is a temporary locking device that does not become a permanent part of the structure on which it serves.

Locks may also be designated by use, that is, automobile lock, suitcase lock, panic or exit lock, coinbox lock, bicycle lock, telephone lock and many others. However, most suitcase locks on the market are undesirable. For the purpose of overcoming the drawbacks of the suitcase locks on the market, the present inventor has made a lock constituted by a combination lock and a key-type lock so that the combined lock may still be opened without being impaired, and the correct numbers of the combination lock can be found out by a decoding rod.

SUMMARY

It is a primary object of the present invention to provide a combined combination and key-type lock which is constituted by a combination lock and a key-type lock.

It is another object of the present invention to provide a combined lock comprising a combination lock and a key-type lock, either or both of which may be used.

It is still another object of the present invention to provide a combined combination and key-type lock which can still be opened by a correct key of the key-type lock when the correct combination of the combination lock is forgotten.

It is a further object of the present invention to provide a compound lock which is convenient to use.

It is still a further object of the present invention to provide a compound lock which is durable.

Other objects and advantages and merits of the present invention will become apparent from reading the following detailed description taken in conjunction with the accompanying drawings.

DETAILED DESCRIPTION OF THE PREFERRED EMBODIMENT

Figure 1:
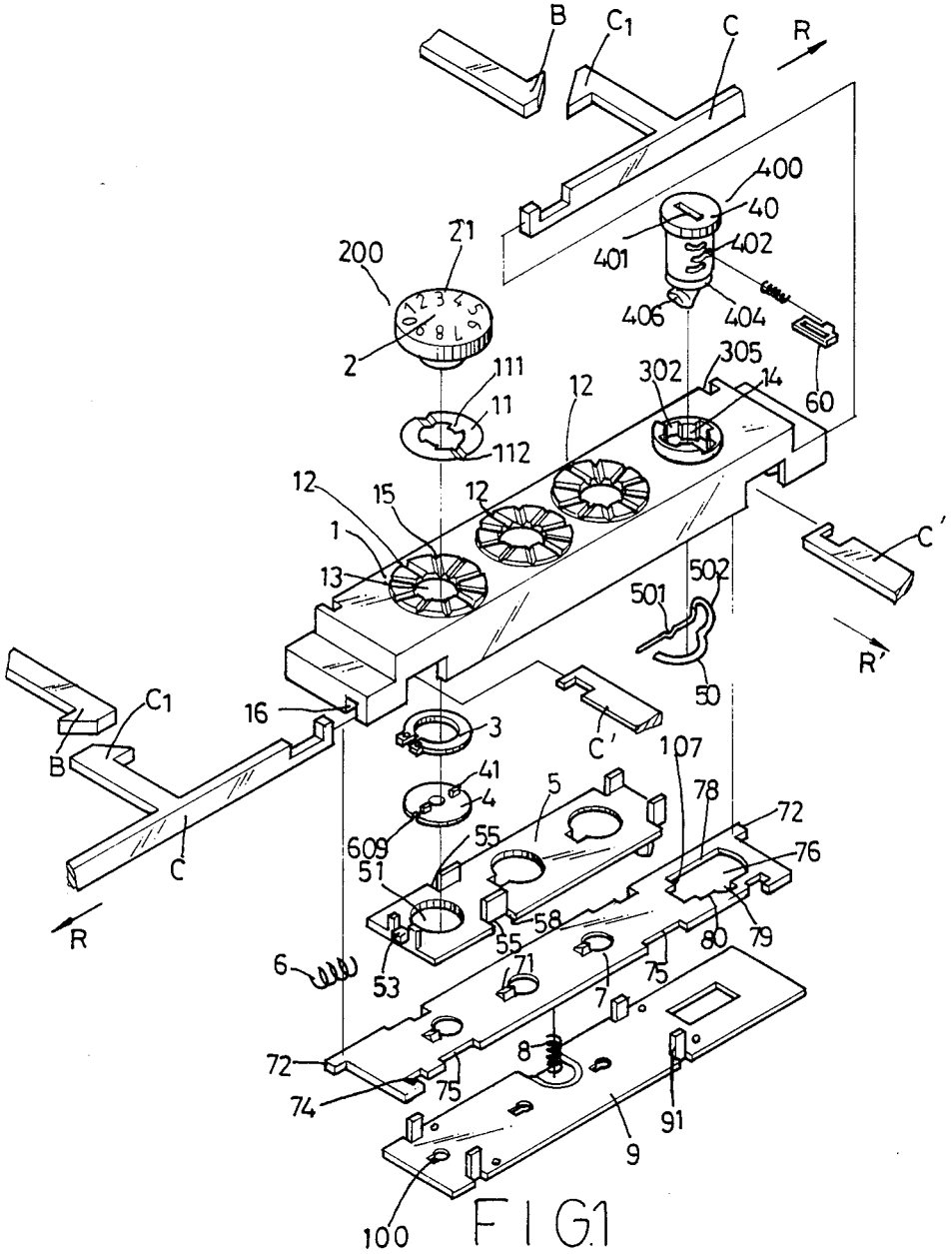
FIG. 1 is a fragmentary perspective view of a combined combination and key-type lock of a preferred embodiment according to the present invention.
Figure 2:
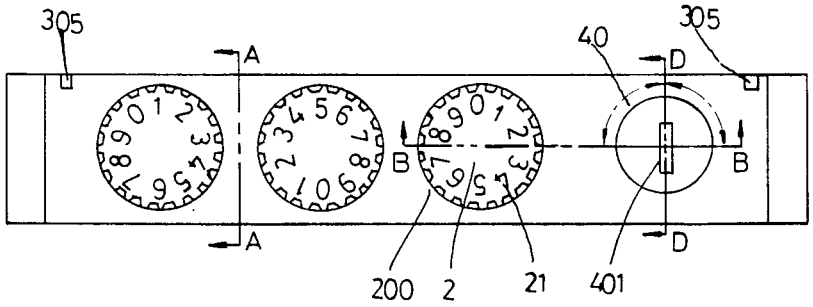
FIG. 2 is a top view of the present lock, showing the plug of the key-type lock in the opening position.

FIG. 1, shows a fragmentary perspective view of a combined combination and key-type lock of a preferred embodiment according to the present invention. The compound lock comprises a combination lock (200) and a key-type lock (400), which may be used individually or jointly. As shown, the lock comprises a casing (1) which is fastened to a suitcase (not shown) by screwing or riveting. The casing (1) is provided with three openings (13) into each of which is mounted a dial (2) of the combination lock (only one of the dial (2) is shown) and an opening (14) into which is mounted a key-type lock (400). Inside the casing (1) is a locking plate (7) which will lock the lock when engaged with elements (C) or (C') and will open the lock when disengaged from the elements (C) or (C'). It should be noted that only elements C or elements C' are required to adapt for use with the locking plate 7. This depends on the design. Each of the elements (C) or (C') is provided with a hook (C1) which will engage with a hook (B) fixedly attached to the cover of the suitcase when the suitcase is locked. When the correct key of the key-type lock (400) is inserted and the correct numbers of the combination lock (200) are dialed, the locking plate (7) will disengage from the elements (C) or (C') which are in turn forced to go out of the casing (1) in direction (R) or (R'). As a result, the hooks (C1) of the elements (C) or (C') will be separated from the hooks (B) and the suitcase may be opened. When no key or a wrong key is inserted into the key-type lock (400) and the combination lock (200) is not dialed with correct numbers, the locking plate (7) cannot be separated from the elements (C) or (C'), i.e., the suitcase cannot be opened. Further, the dials (2) of the combination lock (200) are located above the casing (1), thus facilitating the turning of the dials (2) of the combination lock (200). At the upper edge of each opening (13) are ten notches (15). At each end side of the casing (1) is a slot (16) through which the corresponding element (C) may go into the casing (1) so as to connect with a slot (74) of the locking plate (7).

Referring to the drawings and in particular to FIGS. 1, 2, 5 and 6 thereof, the top surface of each dial (2) of the combination lock (200) is provided with 10 numerals (21). At the bottom of each dial (2) are ten teeth (24) arranged in such positions that each of the teeth (24) is aligned with one of the numerals (21). Between every two teeth (24) of each dial (2) is a bottomland (25). The lower part of each dial (2) is engaged with a ring (11). Each dial (2) is rotatably mounted to the casing (1) by inserting a snap ring (3) into circular slot (23) of each dial (2). Notches (22) of each dial (2) are used to engage with protuberances (111) of the ring (11) so that the ring (11) may rotate with the dial (2). When feet (112) of the ring (11) fall into the notches (15) of the casing (1), one of the numerals (21) will align with an indicating line (12) of the casing (1), thus making the alignment of numerals (21) easier.

With reference to FIGS. 1, 7, 8, 9 and 10, under each dial (2) is a driven disc (4) which is provided with two protuberances (41) used to engage with the bottomlands (25) of the dial (2). At the lower part of each of the driven disc (4) is a notch (42) which serves to determine the locking position of the combination lock (200). Each driven disc (4) is rotatably mounted in a hole (51) of a fixing plate (5). The fixing plate (5) is confined into the casing (1) by columns (18) (shown in FIG. 23) of the casing (1) at the other end. Edges (55) of the fixing plate (5) are engaged with the columns (18) of the casing (1) so that the movement of the fixing plate (5) is limited with a predetermined range. Further a helical spring (6) engages tongue (53) of the fixing plate (5) at one end and is connected to a recess (19) (shown in FIG. 23) of the casing (1) at the other end so that the fixing plate (5) will be forced to go to the right with respect to FIG. 1. Since each driven disc (4) is engaged with a corresponding dial (2), the driven disc (4) will rotate with the dial (2). Consequently, the positions of the notches (42) of the driven discs (4) will be changed when the dial (2) is rotated.

The locking plate (7) is confined within the casing (1) in a manner such that tongues (72) of the locking plate (7) are positioned into slots (20) (shown in FIG. 23) of the casing (1). Furthermore, one end of a spring (8) is located at the same edge as the two tongues (72) of the locking plate (7) and the other end of the spring (8) is engaged with recess (96) of the base plate (9), so that the locking plate (7) is spring-loaded and may rotate about the axis joining the two tongues (72) of the locking plate (7). The protuberances (91) of the base plate (9) are inserted through notches (75) of the locking plate (7). By means of the resilient force of the spring (8), protuberances (71) of the locking plate (7) will be closely in contact with the lower surfaces of the driven discs (4). When the dials (2) are rotated to the positions where all protuberances (71) of the locking plate (7) engage the corresponding notches (42) of the driven discs (4), the locking plate is forced by the spring (8) to go upward. At that time, the numerals (21) of the dials which are aligned with the indicating lines (12) of the casing (1) are the correct numbers of the combination lock (200). Moreover, the slots (74) will be separated from the elements (C) or (C') and the suitcase may be opened. If any one of the dials (2) is not correctly dialed, a notch (42) of a driven disc (4) will not engage with its corresponding protuberance (71) of the locking plate (7). Thus the locking plate is unable to go upwards, and the slots (74) are still engaged with the elements (C) or (C'), and the suitcase cannot be opened.

Figure 15:
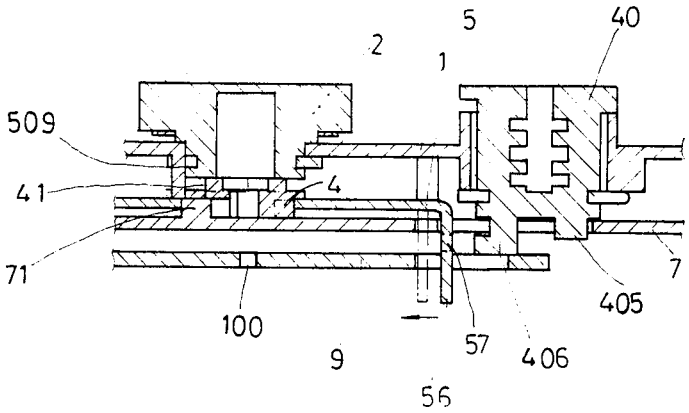
FIG. 15 is a partial sectional view taken along line B—B of FIG. 2, showing the present lock in an open position.
Figure 16:
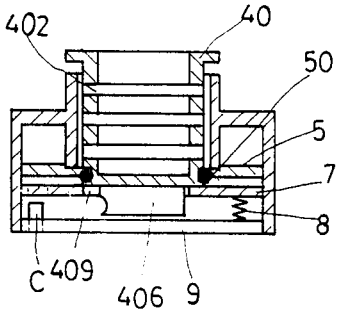
FIG. 16 is a sectional view taken along line D—D of FIG. 2, showing the present lock in an open position.

As shown in FIGS. 15 and 16, when the key-type lock (400) is opened by a correct key (not shown) and the lock 200 are correctly dialed, the positions of the protuberances (71) of the locking plate (7) are aligned with the notches (42) of the driven discs (4); thus the locking plate (7) will go upward to engage with the notches (42) of the driven discs (4) and the present lock may be opened. Further the fixing plate (5) may be moved to the left and dent (609) of each driven disc (4) may engage with a pillar (509) shown in FIG. 23 of the casing (1), thus fixing the position of each driven disc (4).

Figure 17:
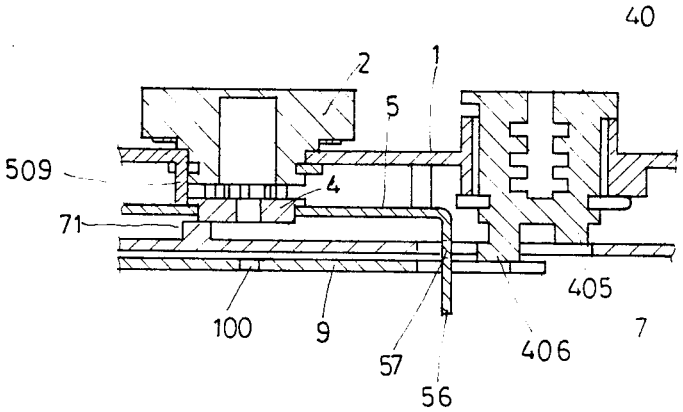
FIG. 17 is a sectional view taken along line D—D of FIG. 2, showing the present lock in a locked position.
Figure 18:
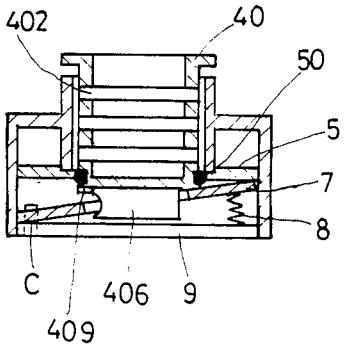
FIG. 18 is a sectional view taken along line E—E of FIG. 3, showing the present lock in a locked position.

As shown in FIGS. 17 and 18, when the key-type lock (400) is opened by a correct key (not shown) but the combination lock (200) are not dialed with correct numbers, the positions of the protuberances (71) of the locking plate (7) will not align with the notches (42) of the driven discs (4); thus the locking plate (7) is prevented from going upward and the compound lock cannot be opened. Further, the arms (57) of the fixing plate (5) will be blocked by edges (107) shown in FIG. 1 of the locking plate (7) and cannot be moved to the left.

Figure 19:
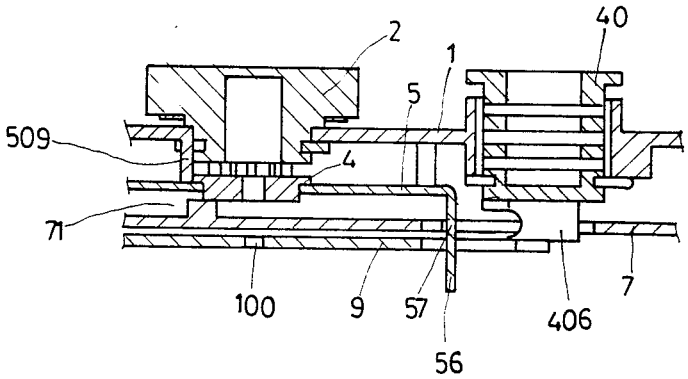
FIG. 19 is a sectional view showing the present lock in a locked position.
Figure 20:
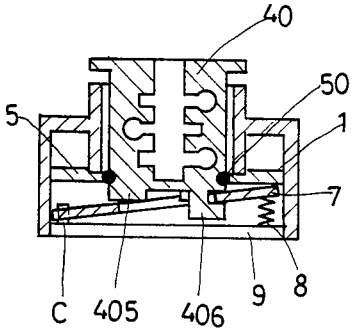
FIG. 20 is a sectional view taken along line E—E of FIG. 3, showing the present key-type lock in a locked position.

As shown in FIGS. 19 and 20, when no correct key is inserted into the key type lock (400) and the combination lock (200) is not correctly dialed, the protuberances (71) of the locking plate (7) will not coincide with the notches (42) of the driven discs (4) and the locking plate (7) will be forced to move to an inclined position, thus locking the present lock.

Figure 4:
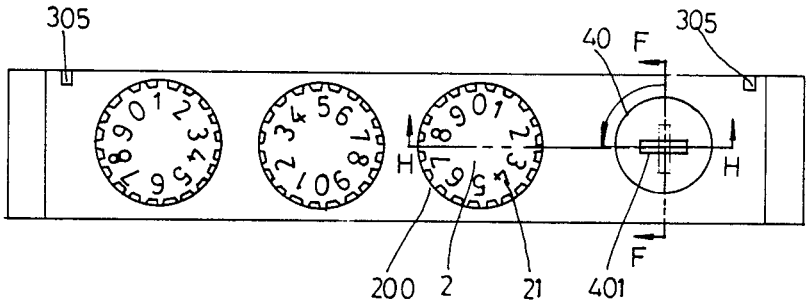
FIG. 4 is a top view of the present lock, showing the plug of the key-type lock in the emergency position.
Figure 5:
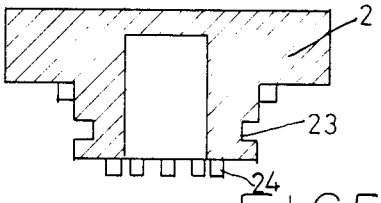
FIG. 5 is cross-sectional view of a dial of the present lock.
Figure 6:
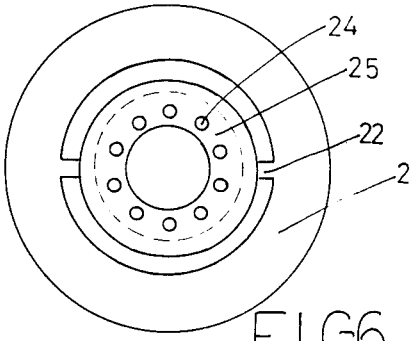
FIG. 6 is a bottom view of the dial of the compound lock.
Figure 7:
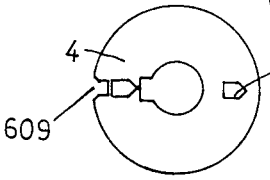
FIG. 7 is a top view of a driven disc of the present lock.
Figure 8:
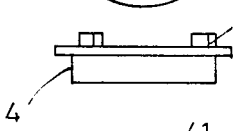
FIG. 8 is a front view of FIG. 5.
Figure 9:
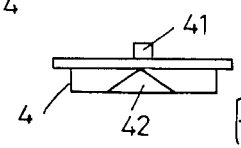
FIG. 9 is another front view of the driven disc of the present lock.
Figure 10:
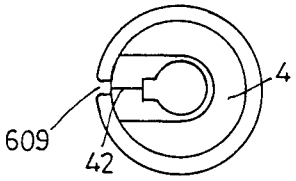
FIG. 10 is a bottom view of FIG. 6.
Figure 21:
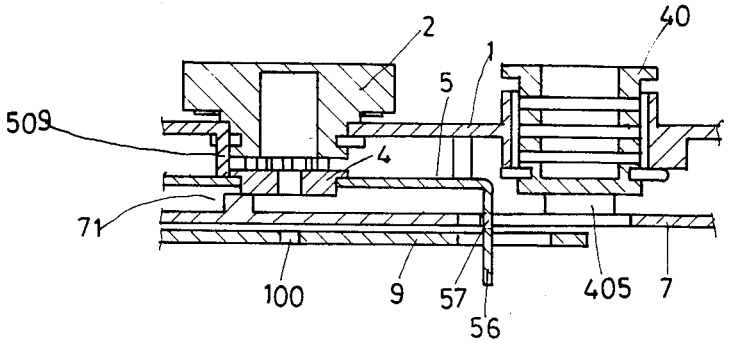
FIG. 21 is a sectional view taken along line H—H of FIG. 4, showing the present lock in a locked position.
Figure 22:
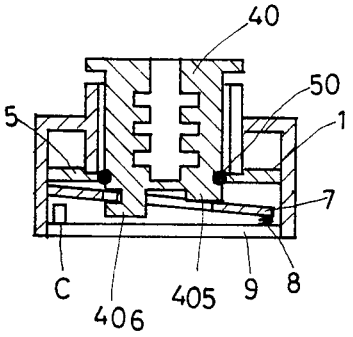
FIG. 22 is a sectional view taken along line F—F of FIG. 4, showing the way to open the present lock while the lock is locked.

As shown in FIGS. 21 and 22, when the combination lock (200) is correctly dialed but the key-type lock (400) is turned by a correct key (not shown) to the emergency position shown in FIG. 4, the locking plate (7) will be forced by hook (406) and projection (405) to incline to the opening position though the protuberances (71) does not coincide with the notches (42) of the driven discs (4).

Figure 24:
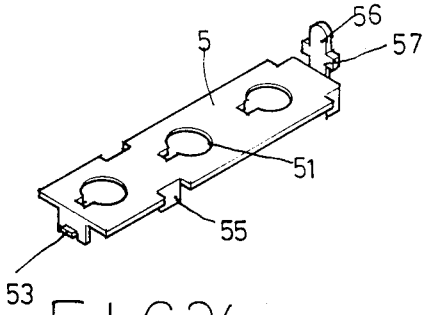
FIG. 24 is a perspective view of the fixing plate (5) reversely positioned.
Figure 25:
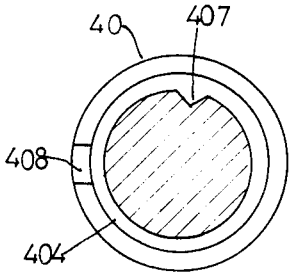
FIG. 25 is a sectional view taken along line F—F of FIG. 11, showing notch (407) and protuberance (409)

With reference to FIG. 24, the fixing plate (5) is further provided with a pushing rod (56) which has two arms (57). As shown in FIGS. 15, 16 and 17, when the lock is unlocked, the locking plate (7) is moved upward and the fixing plate (5) may be pushed to the with respect to FIG. 15. Thus the driven discs (4) disengage from the dial (2). The two arms (57) of the pushing rod (56) are used to prevent the locking plate (7) from moving downward. As a result, the numbers of the combination lock (200) may be changed to any desired numbers by turning the dials (2). It should be noted that the arms (57) of the pushing rod (56) is prevented by edges (107) of the locking plate (7) to move to the left when either the combination lock (200) or the key-type lock (400) is locked.

Figure 11:
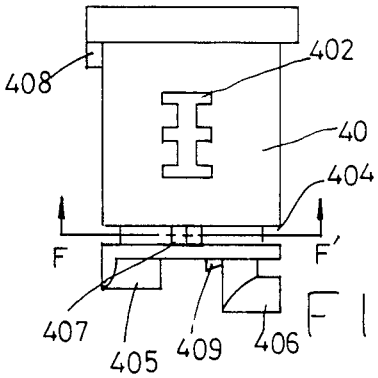
FIG. 11 is a front view of a plug of the present lock.
Figure 12:
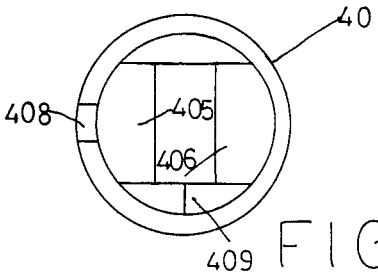
FIG. 12 is a bottom view of the FIG. 9.
Figure 13:
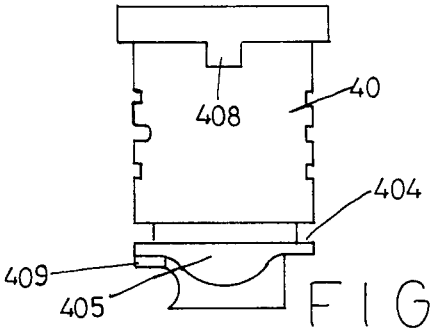
FIG. 13 is another front view of the plug of the present lock.
Figure 14:
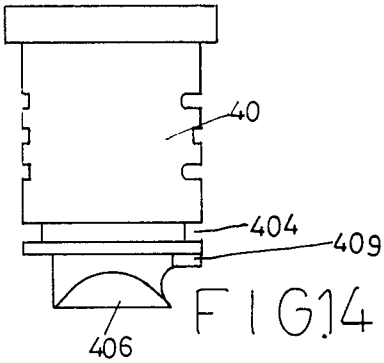
FIG. 14 is still another front view of the plug of the instant lock.

With reference to FIG. 1, the key-type lock (400) is equipped with a plug (40) which is mounted in the opening (14) of the casing (1). The opening (14) is provided with four vertical slots (302). The plug (40) is provided with a key hole (401) in the top and three slots (402) arranged longitudinally in its vertical surface. When no key or a wrong key is inserted, plates (60) of the plug (40) are located inside the slots (302) shown in FIG. 23, thereby preventing the plug (40) from turning. When a correct key is inserted, the plates (60) is forced to withdraw from the slots (302) and the lock (400) may be opened if the combination lock (200) is correctly dialed. In the lower end of the plug (40) is a circular slot (404) which engages with a spring (50) so as to confine the plug (40) within the casing (1). The spring (50) is fixed to the casing (1) by inserting its end (502) into recess (303) of the casing (1) (see FIG. 23). The plug (40) further comprises a projection (405) and a hook (406) (see FIGS. 11, 12 and 13) which are inserted into hole (76) of the locking plate (7). When the plug (40) is rotated through an angle of 90° in the clockwise direction with respect to FIG. 1, the projection (405) forces edge (79) of the hole (76) of the locking plate (7) to move downward, thus engaging the slots (74) with the elements (C) or (C') and the suitcase is locked. The hook (406) of the plug (40) is a device for preventing the plug (40) from getting out of the casing (1) and ensuring the locking plate (7) to move downward when locked.

When the plug (40) is in the open position, protuberance (501) of the spring (50) will go into a recess (407) (shown in FIG. 10) of the plug (40), thereby giving a feeling for positioning.

Figure 23:
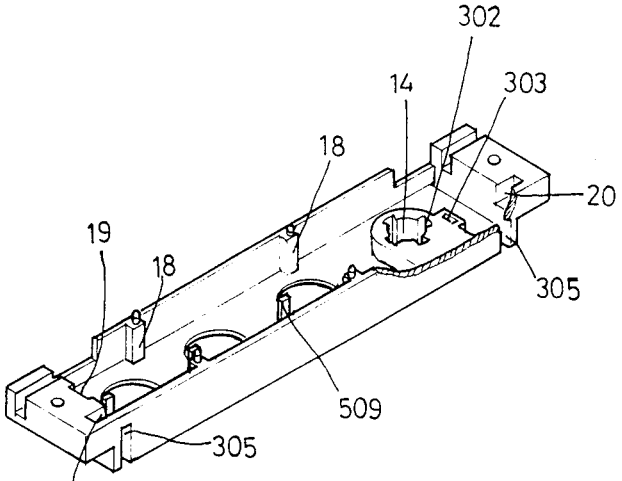
FIG. 23 is a perspective view of the casing (1) reversely positioned.

The columns (18) of the casing (1), shown in FIG. 23, are used to limit the movement of the fixing plate (5). When the fixing plate (5) is in the normal position, the spring (6) will urge edges (55) of the fixing plate (5) to engage with the columns (18) of the casing (1). When the pushing rod (56) is moved to the left, edges (58) of the fixing plate (5) will contact the columns (18) of the casing (1) and the driven discs (4) will be separated from the dials (2), thus enabling the numbers of the combination lock (200) to be changed.

Figure 3:
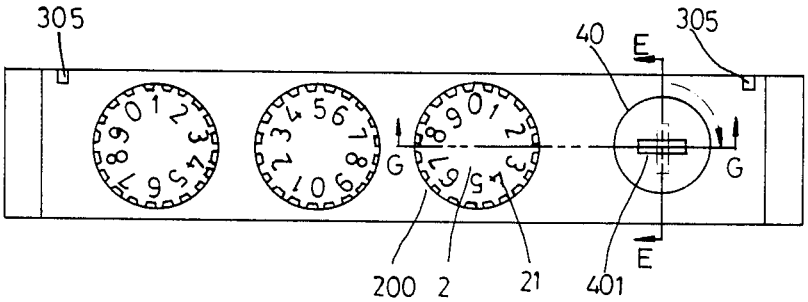
FIG. 3 is a top view of the present lock, showing the plug of the key-type lock in the locking position.

Further, the plug (40) is provided with a protuberance (409) which is hampered by edge (79) of the locking plate (7) when the combination lock (200) is opened so that plug (40) can only be rotated to the position shown in FIG. 3 when the combination lock (200) is opened. Only when the combination lock (200) is opened, the locking plate (7) is rotated to such a position that the protuberance (409) of the plug (40) will not be hampered by the edge (79) of the locking plate (7), i.e., the plug (40) may be rotated to the emergency position as shown in FIG. 4.

Figure 26:
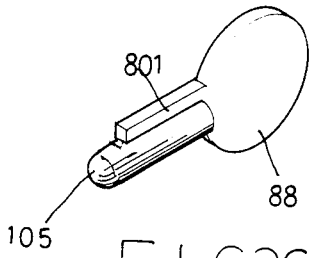
FIG. 26 is a perspective view of a decoding rod.

When the combination lock (200) is locked and the correct combination therefor is not available or cannot be recalled, the compound lock can still be opened and the correct numbers of the combination lock (200) may be found by the following procedures. First, insert a correct key (not shown) of the key-type lock (400) into the key hole (401) of the key-type lock (400), and then turn the key to the position shown in FIG. 4. Thus, the hook (406) of the plug (40) will lift edge (80) of the opening (76) of the locking plate (7) while protuberance (405) of the plug (40) will force edge (78) of the opening (76) of the locking plate (7) to go downward, as shown in FIG. 22. Consequently, the elements (C) or (C') will disengage from the slots (74) of the locking plate (7) and the present lock may now be opened. Then insert a decoding rod (88) (shown in FIG. 26) into the lock through a hole (100) of the base plate (9) so that the tip (105) of the decoding rod (88) is inserted into a key hole (43) of the driven disc (4) while the upper edge (801) of the decoding rod (88) is in contact with the surface of the driven disc (4). The dial (2) aligned with the decoding rod (88) is turned until the upper edge (801) of the decoding rod (88) is inserted into a key way (45) of the key hole (43). At that time, the dial (2) cannot be turned any more and the number aligned with the indicating line (12) is the correct number of the combination lock (200). Repeat the same procedure in the other dials (2) until the correct number of each dial (2) has been found.

Furthermore, when the present lock is opened, the combination lock (200) may randomly be rotated so that the chance of exposing the correct numbers of the combination lock (200) may be decreased.

I claim:

1. A combined combination and key-type lock comprising:

a casing having a plurality of circular openings and a slotted opening;

a plurality of dials corresponding to the circular openings of said casing, each dial extending through each circular opening of said casing and having at the bottom thereof a plurality of teeth;

a fixing plate placed inside said casing, said fixing plate having a plurality of holes corresponding to the circular openings of said casing and a cross-shaped pushing rod extending downwardly from one end thereof, and spring means for urging the fixing plate towards the end of the pushing rod, a plurality of driven discs corresponding to the holes of said fixing plate, each driven disc being mounted on one hole of said fixing plate and having a keyhole in the center, each driven disc being provided on the top with two protuberances engageable with the teeth of the dial so that said driven disc can be rotated in unison with the dial;

a locking plate located under said fixing plate, said locking plate having a plurality of holes corresponding to holes of said fixing plate, an opening aligned with the slotted opening of said casing, two tongues acting as an axis about which said locking plate may rotate, two slots each of which engages a locking element when the combined combination and key-type lock is locked and disengages when the combined combination and key-type lock is opened;

a plug of a key-type lock engaging the slotted opening of said casing, said plug having a hook, a projection, ensuring that said locking plate can be inclined to an opened position by a correct key of said plug when any one of the notches of said driven discs does not coincide with corresponding protuberance of said locking plate, said protuberance serving to prevent said plug from turning to an emergency position when the notches of said driven discs coincide with corresponding protuberances of said locking plate but allowing said plug to turn to the emergency position when the notches of said dials do not coincide with corresponding protuberances of said locking plate; and a base plate forming the bottom of said casing, said base plate having a plurality of holes corresponding to holes of said fixing plate, a spring means being disposed between the locking plate and the base plate to urge the locking plate towards the fixing plate.

* * * * *